United States Patent [19]

Weidmann

[11] Patent Number: 4,927,093

[45] Date of Patent: May 22, 1990

[54] METHOD FOR BRAKING A MOVING THREAD-LIKE MATERIAL AND THREAD BRAKE FOR CARRYING OUT SAID METHOD

[75] Inventor: Erich Weidmann, Wetzikon, Switzerland

[73] Assignee: Gebrueder Loepfe AG, Wetzikon, Switzerland

[21] Appl. No.: 294,751

[22] Filed: Jan. 9, 1989

[30] Foreign Application Priority Data

Jan. 15, 1988 [CH] Switzerland ..... 00146/88

[51] Int. Cl.[5] ..... B65H 59/26

[52] U.S. Cl. ..... 242/154

[58] Field of Search ..... 242/154, 153, 147 R, 242/45, 36

[56] References Cited

U.S. PATENT DOCUMENTS

| | | | |
|---|---|---|---|
| 2,615,656 | 10/1952 | Strake | 242/154 |
| 2,618,445 | 11/1952 | Buder | 242/154 |
| 2,732,142 | 1/1956 | Grein | 242/154 X |
| 2,738,141 | 3/1956 | Klein | 242/154 |
| 2,754,071 | 7/1956 | Furst | 242/154 |
| 2,922,598 | 1/1960 | Heijnis | 242/154 |
| 2,964,259 | 12/1960 | Peel | 242/154 |
| 3,087,689 | 4/1963 | Heim | 242/154 |
| 3,300,161 | 1/1967 | Hermanns | 242/154 |
| 3,578,256 | 5/1971 | Vermeulen | 242/154 X |

FOREIGN PATENT DOCUMENTS 3148151 5/1982 Fed. Rep. of Germany .

*Primary Examiner*—Stanley N. Gilreath

*Attorney, Agent, or Firm*—Bachman & LaPointe

[57] ABSTRACT

A method and an apparatus for braking a moving thread are described, in which the braking effect is not brought about by a clamping of the thread but by looping same around braking elements. The braking effect can be adjusted in several ways, whereby an adaptation to the material and the working conditions can be achieved. In addition, the thread can be braked continuously or discontinuously.

24 Claims, 2 Drawing Sheets

METHOD FOR BRAKING A MOVING THREAD-LIKE MATERIAL AND THREAD BRAKE FOR CARRYING OUT SAID METHOD

BACKGROUND OF THE INVENTION

The present invention relates to a method for braking a moving thread-like material, more especially in textile machines, and a novel thread brake device for carrying out said method.

In the hitherto known thread brakes and thread braking methods, for example in accordance with the DE OS 31 48 151 assigned to LOEPFE BROTHERS LIMITED, the moving thread or thread-like material is braked with a clamping effect and is guided between a fixed and a movable brake shoe, where the movable brake shoe is actuated by an electro-magnet controlled by a brake-thread control device so as to press the thread against the fixed brake shoe, thus clamping the thread between them. A somewhat resilient steel band has also been proposed for use as the fixed brake shoe. For releasing the thread brake when the electro-magnet does not carry current, there is employed a spring as return means, which brings back the movable brake shoe into its rest or starting position.

A thread brake of this kind, based on the principle of clamping and having such a structure has substantial disadvantages which, especially in the case of polypropylene or jute threads, lead to operational breakdowns in a very short time. For example, in the case of polypropylene thread material, the steel bands used as fixed brake shoes were destroyed in the matter of a few working shifts. In addition, after only a relatively few hours of operation, due to the erosion of fibre components and fibre-finishing substances, walls of detritus built up beside the thread track the, against which the brake shoes came to bear without effectively braking the thread. This leads to loose warp threads and thus to fabric defects. The damage which is particularly great is due to the circumstance whereby a wrongly or not inserted thread destroys the production of a large number of meters, up to 100 m, of defect-free fabric and thus a single, wrongly fed-in thread can destroy a large quantity of the product and waste a large number of working hours, because the short pieces of fabric thus produced often cannot be further processed to an equivalent extent. These losses add to the change-over losses, but in general are much larger than these. To this must also be added the material costs and the very high costs of production storage. Furthermore, the very high switching frequencies, due to the increasingly high operating speeds of the textile machines, cannot be attained with the known thread brakes. With these thread brakes, at the speeds now currently worked, the thread cannot be braked at the correct instant and with such accuracy as to produce defect-free fabrics.

The task underlying the invention is one of providing a method and a thread brake for the braking of moving threads, especially in textile machines, by means of which even very hard and fibrous threads can be braked reliably and precisely relative to the intended use of the thread, in short braking times and at higher switching frequencies and number of connections than hitherto, and that a self-cleaning effect occurs or soiling has no appreciable effect on the effectiveness of the braking. In addition, the high underlying disturbance level is to be reduced and its influence diminished.

Accordingly it is a principle object of the present invention to provide a method for braking a moving thread-like material and an apparatus for carrying out said method which overcomes the aforesaid disadvantages.

SUMMARY OF THE INVENTION

The foregoing objects and advantages are readily obtained by providing a method for braking a moving thread-like material which comprises providing a brake body having a plurality of thread guide means, biasing the brake body to a first position so as to allow the thread-like material to be drawn through the thread guide means and thereafter feeding the thread-like material through the plurality of thread guide means, providing a brake head having a plurality of braking elements and selectively biasing the plurality of braking elements against the thread-like material whereby the brake body is gradually moved from its first position against the force of the biasing means by the thread-like material to a second position where the thread-like material is alternately looped between the thread guide means and the brake elements for braking the thread-like material such that the brake is gradually applied without clamping the thread-like material thereby avoiding snapping of same. When the brake body is in the second position, the plurality of brake elements interdigitate with the plurality of thread guide means. The brake for carrying out the method in accordance with the present invention includes a pivotable rocker arm having a plurality of eyelets formed thereon which form the thread guide means. The pivotable rocker is pivoted in response to the force applied to the thread-like member by the plurality of brake elements which comprise rod-like members secured to a brake head which is movable by means of a pivotable arm. The pivotable arm carries a magnet which is attracted by an electromagnet carried by the brake device when the electromagnet is energized.

By way of the device and method of the present invention, the disadvantages noted above with regard to heretofore known thread brake devices are overcome.

BRIEF DESCRIPTION OF THE DRAWINGS

Further features of the invention will be apparent from the description of the method and of examples of embodiment of the device with reference to the drawing. In the drawing.

DETAILED DESCRIPTION

Figure 1:
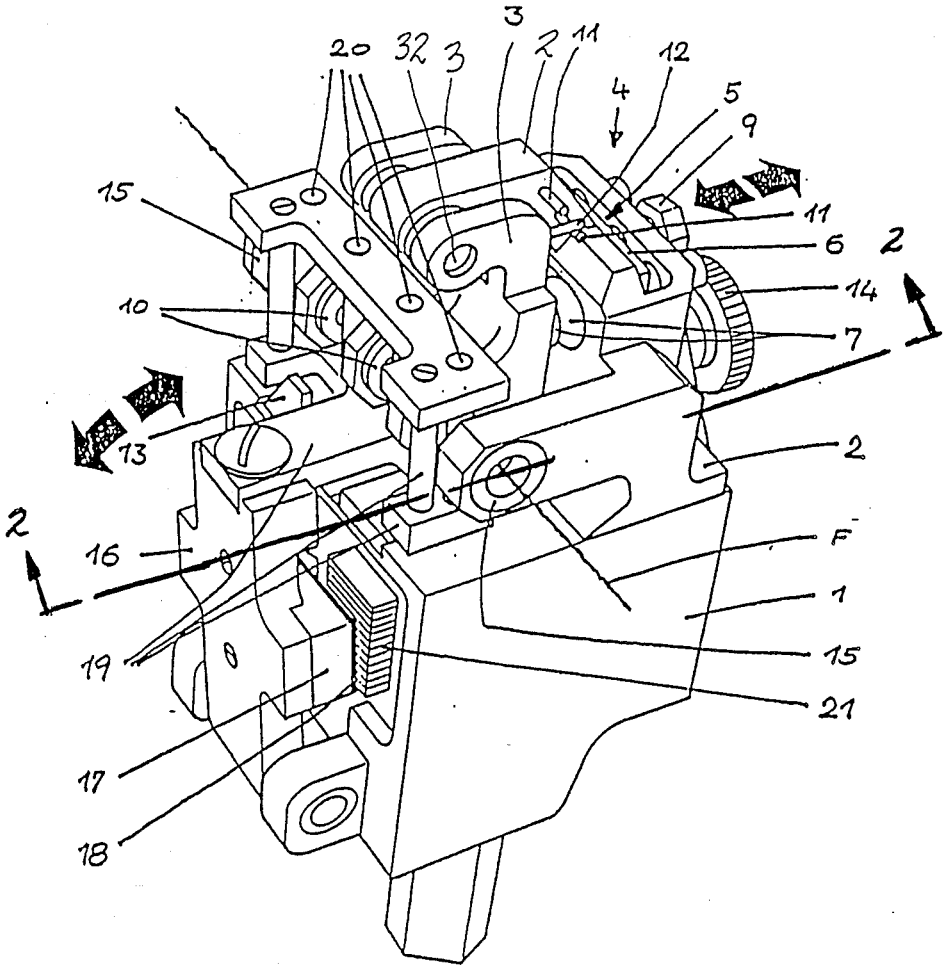
FIG. 1 shows the braking assembly of a thread brake in an oblique elevation.
Figure 2:
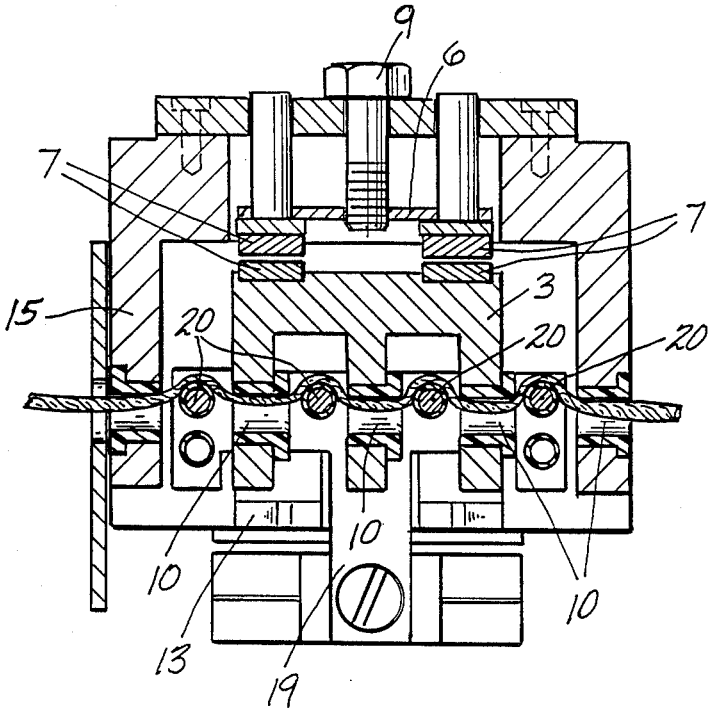
FIG. 2 is a partial sectional top view taken along lines 1—1 of FIG. 1 showing the thread braking device of the present invention in its braking mode.

In the method according to the invention for braking a moving thread or thread-like material, the thread is guided along brake elements, its normal thread path not being affected by said brake elements when in the raised braked position of the brake. During the braking process, the brake elements which belong to two brake element groups and which are in an alternating arrangement along the thread axis, are moved against the thread, thereby deflecting the thread into a meandering path, whereby owing to the friction on the brake elements the thread is braked or is brought to a complete standstill, without being clamped. The braking effect is brought about by a variation of the meandering form of the thread axis or path, thereby effecting the looping around the braking elements, this being achieved by means of a positioning device, which displaces one group of brake elements relative to the other group of brake elements or relative to the normal thread axis, respectively. The braking effect may also be brought about, possibly additionally to the above described possibility of variation, by an intermittent movement of the one brake element group relative to the other brake element group, that is to say, one brake element group executes a vibrating motion to effect thread braking, which is controlled by the thread-brake control device.

The thread brake has a brake support 1 (or a housing), on which a carriage-like positioning device 2 is displaceably mounted and can be locked into position by means of a positioning screw 14. The positioning device 2 carries a brake body constructed as a deflectable element which has the configuration of a rocker 3 which is pivotable on rod 30, mounted in device 2 and an adjusting device 4 for a power element 5. Power element 5 is constructed as a slidable crossbar 6 which carries a part of the power element magnet 7 while an other part of the power element magnet 7' is arranged within the rocker 3 such that the two parts, i.e. magnets 7 and 7' repel each other owing to their opposing polarity. The crossbar 6 is adjustable relative to the rocker 3 by means of crossbar-adjusting screw 9, said screw being seated in the adjusting device 4 for the power elements. The rocker 3 carries brake elements which are eyelet-shaped thread guides 10. On the positioning device 2 there are arranged in a suitable manner two rocker stops 11 formed as cylindrical pins which cooperate with a rocker pin 12 on rocker 3 for limiting the pivotable movement of rocker 3. There is also provided on positioning device 3 a brake head stop 13 for frame 19, in which arrangement both the rocker stops 11 and the brake head stop 13 delimit for both rocker 3 and frame 19 an appropriate range of movement with respect to the thread F in its normal position. Further, on the front-face ends of the positioning device 2 which extend perpendicularly to the thread axis, there is arranged a fixedly mounted thread guide element 15 each of which is of eyelet-shaped configuration for the purpose of better thread guidance. Mounted for pivotable movement on rod 32 in the brake support 1 is a brake head in the form of a pivotable bracket 16 which carries frame 19. On this bracket 16 is mounted a permanent magnet 17 which carries an iron platelet 18 to improve its magnetic force effect. In addition, on the free end of the bracket 16, there are mounted brake bodies 20, in a number matching that of the eyelet-shaped thread guides 10, which are constructed as rod-like thread guide elements of the brake head and are supported in frame 19. The spacing of the rod-like thread guide elements 20 relative to each other is so selected, that they are located along the thread axis alternating with the eyelet-shaped thread guide elements 10.

On the brake support 1, opposite the pivotable bracket 16, a first electro-magnet 21 is fastened which, depending on the current supplied and polarization from a thread-brake control device acts to attract or repulse permanent magnet 17 and thereby bracket 16. The thread-brake control device is actuated in known manner for generating the signals for the electro-magnet 24 for actuating the thread brake.

In response to a generated signal 27 and the projectile sensor 26, the thread-brake control device produces a current pulse of specific duration for the first electro-magnet 21, by which it is so polarised, that it attracts the permanent magnet 17. This causes the bracket 16 to pivot for its neutral position with the rod-like thread guide elements 20 against the thread F and between the eyelet-shaped thread guide elements 10 of the rocket. The thread is pressed against the eyelet-shaped thread guide elements 10, whereby the rocker is pivoted from its rest position against the force of the power element magnet 7 towards the crossbar 6 of the adjusting device 4. The thread loops itself about the brake elements of the bracket and the rocker in a meandering path and is braked by the friction against these either to a lower speed or to a complete standstill. When thread-brake control device switches off the current for the electro-magnet 21, bracket 16 is moved to its neutral position due to the force of the permanent magnet 17 where the thread brake is partially released and the thread is held to an appropriate extent. When the thread-brake control device 24 applies a current pulse of inverse polarity and suitable magnitude to the electro-magnet 21 the latter repels the permanent magnet 17, and thus causes the thread brake to be completely released.

In a further variant, the thread brake can be operated by the thread-brake control device with discontinuous current pulses for the electro-magnet 21 such that the bracket 16 and accordingly the rod-shaped thread guide elements 20 are vibrating to and fro so as to effect an alternatingly stronger and weaker tightening of the brake. By this means it can be achieved that the thread is practically permanently braked to some extent and is thus running tensioned at all times.

In a further variant, above described instead of the permanent magnet a second electro-magnet can be provided mounted on the bracket 16. The effect is correspondingly the same, the only difference being that in case of current-free thread brake the thread is not held automatically. Thus, the thread brake is not self-braking.

In yet another variant of the thread brake, the power element 5 can be a spring, which cooperates with the adjustable crossbar 6 and the rocker 3, none of which then has power element magnet 7.

In an additional variant of the thread brake, the eyelet-shaped thread guide elements 10 of the brake body may have thread intake openings (not shown), so that the thread F is not drawn in by auxiliary means in the direction of the thread axis, but is inserted transversely thereto without any auxiliary means.

In a further particular variant it is possible to displace the adjusting device 4 by motor means during the braking process in dependence upon the working cycle of the machine by means of the thread-brake control device and thus to adapt the braking effect even more specifically to material and machine dynamics.

The most significant and important advantages of this thread braking method and thread braking device are a quite substantially increased service life even with difficult, hard and fibrous thread materials, a substantially milder but at the same time more effective braking down to thread standstill, the possibility of graded braking without having to bring the thread to standstill, the possibility of interval-matched braking in accordance with the working cycles even at the highest speeds and the avoidance of great losses in production time and material when long-run, defect-free products are required, etc.

I claim:

1. A thread brake comprising a brake body provided with a plurality of thread guide means for guiding a thread-like material, biasing means associated with said brake body for holding said brake body and said thread guide means in a first position so as to allow said thread-like material to be drawn through said thread guide means, a brake head having a plurality of brake elements and means for selectively biasing said plurality brake elements toward said brake body and against said thread-like material whereby said brake body is gradually moved from said first position against said biasing means by said thread-like material to a second position wherein said thread-like material is alternatively looped between said thread guide means and said brake elements for braking said thread-like material.

2. A thread brake according to claim 1 wherein said plurality of brake elements interdigitate with said plurality of thread guide means when said brake body is in said second position.

3. A thread brake according to claim 2 wherein said brake body is mounted on a positioning device which is selectively movable toward and away from said brake head.

4. A thread brake according to claim 3 wherein thread guides are fixed on said positioning device and are located upstream and downstream of said plurality of thread guide means.

5. A thread brake according to claim 3 wherein said brake body comprises at least one pivotable rocker which is pivotably mounted on said positioning device.

6. A thread brake according to claim 5 wherein said plurality of thread guide means consists of a plurality of eyelets formed in said at least one pivotable rocker.

7. A thread brake according to claim 5 wherein said biasing means comprises first magnet means mounted on said pivotable rocker and second magnet means mounted on said positioning device wherein the polarity of said first and second magnet means is such that said magnet means repel each other for biasing said pivotable rocker to said first position.

8. A thread brake according to claim 7 wherein said positioning device includes means for varying the force of said biasing means.

9. A thread brake according to claim 8 wherein said means for varying the force of said biasing means includes means for positioning said second magnet means relative to said first magnet means.

10. A thread brake according to claim 5 wherein said positioning device includes a pair of stops for limiting the movement of said pivotable rocker between said first position and said second position.

11. A thread brake according to claim 10 wherein said rocker is provided with a cylindrical element for abutting said stops when in said first and second positions, respectively.

12. A thread brake according to claim 3 wherein said positioning device is mounted on a sliding carriage mounted on a brake support and includes means for selectively positioning said carriage on said brake support and locking same into position.

13. A thread brake according to claim 3 wherein said positioning device includes means for varying the force of said biasing means.

14. A thread brake according to claim 1 wherein said plurality of brake elements comprise a plurality of rods mounted on said brake head.

15. A thread brake according to claim 1 wherein said means for selectively biasing said plurality of brake elements comprises a pivotable bracket pivotably mounted on a brake support.

16. A thread brake according to claim 15 wherein said means for selectively biasing said plurality of brake elements further includes a first magnet mounted of said pivotable bracket and a second electromagnet located on said brake support.

17. A thread brake according to claim 16 wherein said first magnet is a permanent magnet.

18. A thread brake according to claim 16 wherein said first magnet is an electromagnet.

19. A thread brake according to claim 16 wherein said permanent magnet is provided with an iron platelet.

20. A thread brake according to claim 16 including means for selectively passing current to said second electromagnet.

21. A method for braking a moving thread-like material comprising providing a brake body having a plurality of thread guide means, biasing said brake body to a first position, feeding said thread-like material through said plurality of thread guide means, providing a brake head having a plurality of braking elements, selectively biasing said plurality of brake elements against said thread-like material, and gradually moving said brake body from said first position against said biasing means by said thread-like material to a second position wherein said thread-like material is alternately looped between said thread guide means and said brake elements for braking said thread-like material such that said brake is gradually applied without clamping said thread-like material thereby avoiding snapping the material.

22. A method according to claim 21 including continuously biasing said plurality of brake elements to provide the braking of the material.

23. A method according to claim 21 including intermittently biasing said plurality of brake elements to provide the braking of the material.

24. A method according to claim 21 including interdigitating said plurality of brake elements with said plurality of thread guide means when said brake body is in said second position.

* * * * *